US007958656B2

(12) United States Patent
Soderberg et al.

(10) Patent No.: US 7,958,656 B2
(45) Date of Patent: Jun. 14, 2011

(54) PORTABLE OR TOW-BEHIND SNOW MELTER

(76) Inventors: Mark Soderberg, Evergreen, CO (US); Gary Rogers, Camano Island, WA (US)

( * ) Notice: Subject to any disclaimer, the term of this patent is extended or adjusted under 35 U.S.C. 154(b) by 0 days.

(21) Appl. No.: 12/116,543

(22) Filed: May 7, 2008

(65) Prior Publication Data

US 2008/0276498 A1 Nov. 13, 2008

Related U.S. Application Data

(60) Provisional application No. 60/928,245, filed on May 7, 2007.

(51) Int. Cl.
*E01H 5/10* (2006.01)
*E01H 5/00* (2006.01)

(52) U.S. Cl. ..... 37/228; 37/226

(58) Field of Classification Search ..... 37/199, 37/226, 228, 197, 227
See application file for complete search history.

(56) References Cited

U.S. PATENT DOCUMENTS

| | | | | | |
|---|---|---|---|---|---|
| 2,729,000 | A | | 1/1956 | Bros et al. | |
| 3,052,231 | A | | 9/1962 | West et al. | |
| 3,066,428 | A | * | 12/1962 | Raiti | 37/228 |
| 3,171,405 | A | * | 3/1965 | Miller | 126/343.5 R |
| 3,309,798 | A | * | 3/1967 | Devlin et al. | 37/228 |
| 3,353,286 | A | * | 11/1967 | Marks | 37/228 |
| 3,540,430 | A | | 11/1970 | Rudnik | |
| 3,766,586 | A | | 10/1973 | Krickovich | |
| 3,979,794 | A | * | 9/1976 | Brown | 37/228 |
| 4,164,820 | A | * | 8/1979 | Krickovich | 37/229 |
| 4,226,034 | A | | 10/1980 | Benjamin et al. | |
| 4,506,656 | A | * | 3/1985 | Baasch | 126/343.5 R |
| 4,676,224 | A | * | 6/1987 | Ohno | 126/343.5 R |
| 4,898,333 | A | | 2/1990 | Kime et al. | |
| 5,642,673 | A | * | 7/1997 | Lucky, Sr. | 104/279 |
| 5,643,482 | A | * | 7/1997 | Sandelman et al. | 219/497 |
| 5,791,335 | A | * | 8/1998 | Luciani | 126/343.5 R |
| 5,953,837 | A | * | 9/1999 | Clifford | 37/228 |
| 5,956,872 | A | | 9/1999 | Mavrianos | |
| 6,223,742 | B1 | * | 5/2001 | Macameau | 126/343.5 R |

(Continued)

FOREIGN PATENT DOCUMENTS

JP 02277961 A * 11/1990

OTHER PUBLICATIONS

Snow Dragon Melters Website, Products Page; http://www.snowdragonmelters.com/products.aspx; Aug. 26, 2008.

(Continued)

*Primary Examiner* — Thomas B Will
*Assistant Examiner* — Abigail A Risic
(74) *Attorney, Agent, or Firm* — Madson IP, P.C.

(57) ABSTRACT

A snow melter that may be used to melt snow. The snow melter includes a dump tank for receiving a quantity of snow to be melted. The melter also includes a melt tank and a heat exchanger. The melt tank separate from the dump tank. The heat exchanger heats the water in the melt tank. Water heated by the melt tank is allowed to flow from the melt tank into the dump tank to melt the snow in the dump tank. Doors may also be added to the dump tank to facilitate the removal of debris from the dump tank after use. Further, the dump tank may also have an inclinable floor to further facilitate the removal of debris from the dump tank after use.

17 Claims, 7 Drawing Sheets

U.S. PATENT DOCUMENTS

| | | | | |
|---|---|---|---|---|
| 6,305,105 | B1 * | 10/2001 | Lowman | 37/228 |
| 6,971,596 | B2 * | 12/2005 | Monroe | 241/86.1 |
| 2004/0074114 | A1 | 4/2004 | Rogers | |
| 2008/0178866 | A1 * | 7/2008 | Davies | 126/343.5 R |

OTHER PUBLICATIONS

Snow Dragon Melters Website, "Snow Melters SND900"; http://www.snowdragonmelters.com/SND900.aspx; Aug. 26, 2008.

Snow Dragon Melters Website, "Snow Melters SND1800"; http://www.snowdragonmelters.com/SND1800.aspx; Aug. 26, 2008.

Snow Dragon Melters Website, "Snow Melters SND5400"; http://www.snowdragonmelters.com/SND5400.aspx; Aug. 26, 2008.

Trecan Combustion Technology Solutions Website, "Trecan Snow Melting Equipment" brochure; http://www.trecan.com/webe3/EnglishBrochure.pdf; Aug. 26, 2008.

* cited by examiner

PORTABLE OR TOW-BEHIND SNOW MELTER

CROSS-REFERENCED RELATED APPLICATIONS

This application claims the benefit of U.S. Provisional Patent Application No. 60/928,245, filed May 7, 2007. This provisional application is expressly incorporated herein by reference.

BACKGROUND OF THE INVENTION

Municipalities, communities, resort areas, airports, and maritime locations, etc. often need to melt snow after large snow storms. Such winter storms can disrupt travel, hinder commerce, and otherwise cause problems. Accordingly, such entities will often go to great lengths to remove the snow as soon as possible in order for transportation services to get back on track and moving.

One way to remove large amounts of snow is to use commercial snow melting devices. These devices are sometimes referred to as "snow melters." There are currently known snow melters offered to the marketplace. Trecan, a Canadian company, offers snow melting products using a submersible combustion system. While efficient at melting snow, this process consists of firing a flame or series of flames through a diesel fired (in most cases) burner into a weir that is submerged in the melt tank or snow dump area. That flame and exhaust warm the in-tank water temperature to the pre-determined level, cause underwater turbulence which assists in melting the snow that has been dumped or blown into the melt tank. All of the exhaust particulates escape into the melt water exiting the snow melter and into the storm drains, settling ponds, etc. This snow-melting process is efficient but very dirty.

A second type of melt process available to the marketplace is a direct fired melter, which employs the use of a jet turbine engine fired directly at the snow as it is dumped into a holding tank or melt tank. This process is very efficient, but absolutely filthy, emitting volumes of exhaust carbons for long distances especially in a windy location, and covering autos, buildings, lawns in the surrounding areas of operation, etc. The operation of this type of melter has been banned in at least one large airport location, except in dire or emergency situations. This application requires enormous fuel consumption—roughly 700 gallons per hour ("GPH").

Accordingly, there is a need in the art for a new type of snow melter that is efficient to use, clean, portable, and inexpensive to use. Such a device is disclosed herein.

BRIEF SUMMARY OF THE INVENTION

The present system is a portable snow melter. This snow melter may be used in municipal, resort, maritime and airport environments where, after a normal to major winter snow storm, it is necessary for transportation services to get back on track and moving. The melter alternative is both efficient and less costly, based upon distances to haul snow to permanent dump sites and the relative comparative costs involved; fuel, labor, equipment, etc.

This snow melter comprises two tanks which may be adjacent to each other. These two tanks are the melt tank and the dump tank. Snow is dumped into the dump tank whereas water is heated via a heat exchanger in the heat exchanger tank. The main concept is to have a dumping tank where snow is dumped separated from a heat exchanger tank. This way debris in the snow is not dumped directly on top of the heat exchanger. The heat exchanger may be a fully enclosed fire tube, wet back heat exchanger. In the current embodiment, a 2-pass exchanger is employed. An oil fired flame travels down the length of a larger diameter Morrison tube and then an enclosed turnaround box distributes the hot air and gases back through hundreds of small tubes where they meet an exhaust box where these air and gases are collected and exhausted through a stack. These exchangers are normally designed to achieve approximately 85% efficiency. The in-tank water to be warmed comes in contact with all of the surface area of the large and small tubes and collection boxes.

There are two primary water flows in operation. First, there is pumped circulation between the dump tank and the melt tank, meaning that water is pumped from the dump tank into the melt tank. Water is then returned to the dump tank via an overflow weir. The water level in the melt tank is higher than the dump tank to allow the water to fall in a waterfall back into the dump tank via the overflow weir. There is another weir (sometimes called a lower weir) in the dump tank for the exit of the melt water. Additionally, there is a lower weir in the dump tank for the exit of melt water. As snow is added to the dump tank and melted, the water lever rises in the dump tank until it overflows out of the dump tank via this lower weir. This water may then be directed via hoses to the ground, storm drain system, or to another water collection feature. This lower weir may be located at one end of the dump tank. It could further be distributed via ducts around the sides of the dump tank for more even distribution. Alternatively, additional piping or troughs could distribute the water from the upper weir to cascade into the dump tank along several sides to expose more of the snow on the dump tank surface to water directly flowing on it.

However, while the water is in the melt tank (i.e., before returning to the dump tank), the water will be heated by a heat exchanger. In some embodiments, this heating will cause the water to heat to about 39 degrees Fahrenheit. Thus, it is heated water that is returned to the dump tank. Additionally, there is a lower weir in the dump tank for the exit of the melt water out of the dump tank to be disposed of into the storm drain system. In some embodiments, water that leaves the dump tank (via the hoses, etc.) is at a temperature, such as 39° F., that allows the water to be directly poured into drains, etc., without risk that the water will re-freeze.

The heat exchanger is a closed loop system which means that at no time does the burner flame come into contact with the melt water. This makes this system much cleaner than other systems as pollutants formed by the burner never gain access to the water. Rather, the flame and the combustion products are completely housed within tubes that will heat up. These tubes will, in turn, heat up and warm the melt water in the melt tank.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments the present invention, as represented in the Figures, is not intended to limit the scope of the invention, as claimed, but is merely representative of presently preferred embodiments of the invention.

Figure 1:
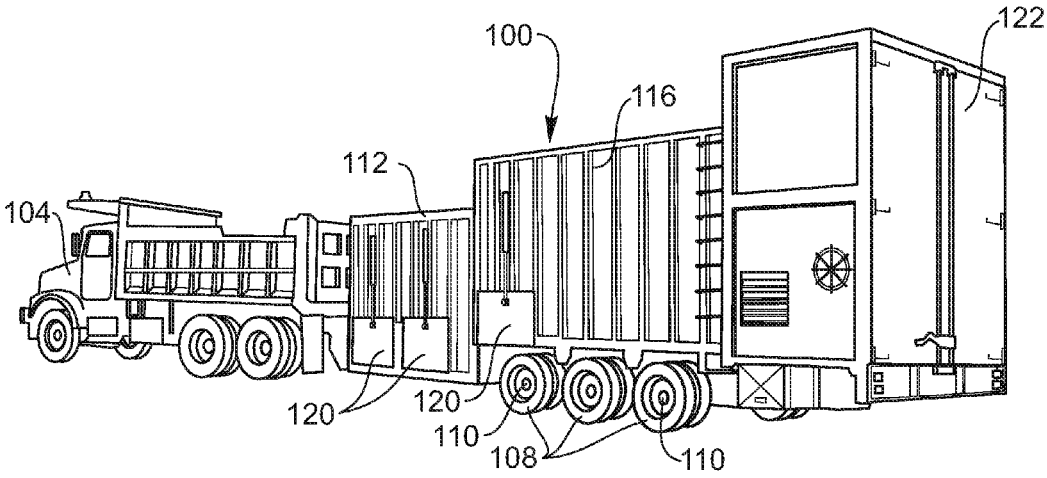
FIG. 1 is a perspective view of a snow melter during transport according to the present embodiments.

Referring now to FIG. 1, a perspective view illustrates an embodiment of a snow melter 100 (which is sometimes called the "melter") that may be used to melt snow. As can be seen in FIG. 1, the snow melter 100 is portable, meaning that it can be towed by a dump truck 104 or other large vehicle. In order to be pulled by the truck 104, the snow melter 100 may include wheels 108 and a trailer hitch (not shown) or other similar device that will allow it to be towed as a trailer behind a truck 104. Those skilled in the art will appreciate the components such as axles 110 (and/or other components such as struts, etc.) that may be necessary to make the snow melter 100 portable and towable behind a dump truck 104.

The melter 100 may include two separate and distinct tanks, namely a dump tank 112 (which is sometimes referred to as a dumping tank) and a melt tank 116 (which is sometimes referred to as a "heat exchange tank"). The heat exchanger tank 116 includes a heat exchanger (not shown in FIG. 1). The dump tank 112 is designed in such that the snow may be dumped or added into the dump tank 112 via a large front end loader or other construction equipment or blown in via a snow blower. That way, the snow is not dumped directly on top of the heat exchanger (in the melt tank 116), which could potentially damage this equipment.

Other types of large capacity snow melting systems must be towed using tractors that have a capacity for greater than 10,000 lbs of trailer tongue weight. This then requires that this specialized equipment be provided by the user to move the equipment because most standard dump trucks are not equipped to tow this type of load. However, embodiments of the melter 100 may be designed in which a conventional dump truck 104 may be used as the towing vehicle. Specifically, the melter 100 may be designed such that the melter would have a tongue weight to be less than 10,000 lbs. This may be done by centering the largest weight of the melt tank 116 and associated water over a three axle 110 set on the trailer. Then cantilevered or extending behind the axles is the weight of the other components of the melter 100 (which, as explained herein, may include the fuel, burner system, and generator). This largely offsets the weight of the empty dump tank 112 which is forward of the axles 110. Then, the tongue weight is primarily any existing water in the dump tank 112, which of course, could be tailored and managed to acceptable levels. Accordingly, in this manner, the weight may be distributed to allow a regular dump truck 104 to be used as the towing device. Of course, other embodiments may also be constructed differently and may require the use of specialized equipment to haul/tow the melter 100.

The dump tank 112 also may include one or more doors 120. These doors 120 are designed to facilitate cleaning out the dump tank 112 after use. Specifically, the snow, when loaded into the dump tank 112, may include debris, tree branches, etc. that may be gathered in the dump tank 112 after the snow has been melted. Accordingly, these doors 120 (although shown in the closed configuration in FIG. 1) may be opened to allow such debris to be removed and cleaned out of the dump tank 112. The doors 120 may also be added to the melt tank 116. A corresponding door 120 on the opposite side of the melt tank 116 may also be added as well. In general, most of the debris will settle out in the dump tank that is designed for easy cleaning rather than settling out under the heat exchanger.

The melter 100 may also include an enclosure 122 that encloses the burner system, the fuel, the controls, the "genset" (typically a diesel driven electric generator), and other components that will be described below. These controls may be used to adjust the melting parameters (such as the heat discharged, the fuel used, etc.). The enclosure 122 may be positioned rearward of the melt tank 116.

Figure 2:
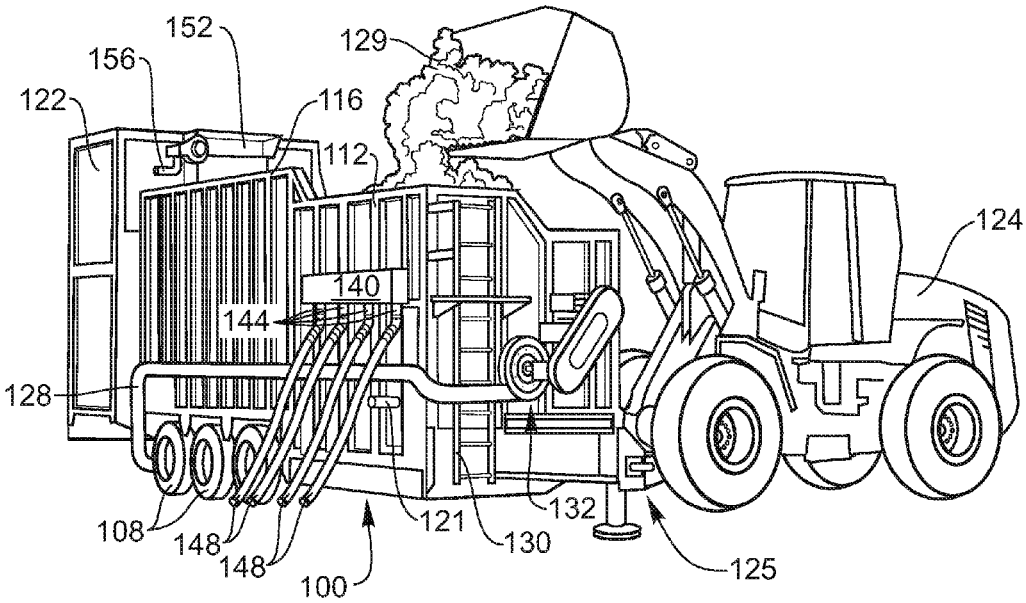
FIG. 2 is a perspective view of the snow melter of FIG. 1 that is shown detached from the two vehicle and in use.

Referring now to FIG. 2, a perspective view of the snow melter 100 is provided which shows the melter 100 in use. Specifically, FIG. 2 shows the reverse side of the melter 100 that was shown in FIG. 1. Accordingly, the doors 120 shown in FIG. 1 are not illustrated in FIG. 2. Further, the pintle hook 125 that may be used to connect the melter 100 to a dump truck 104 (not shown) is illustrated. A ladder 130 may be added to allow a user, if necessary for cleaning or repairs, to access the dump tank 112 and/or the melt tank 116. Drain valves 121 may also be added to the dump tank 112 to further aid in draining the dump tank 112.

As can be seen in FIG. 2, a front end loader 124 (or other piece of construction equipment) may be used to load the dump tank 112 with snow 129. The snow is added to the dump tank 112, not the melt tank 116. The system is initially filled via a fire hydrant or water truck by connecting to the melt tank drain and initially filling the melt tank and then water will cascade over the weir and fill the dump tank. Additional water is then formed by melting snow 129. As snow is also added to the dump tank 112, this water in the dump tank 112 is generally "cold."

In some embodiments, steel deflectors may be added around the top inside of the dump tank 112 that operate to help deflect the water back into the tank 112 when snow is dumped in for cleanliness and to preserve the heated water for melting. The dump tank may have a stepped front face, normally at a 9 foot height to make it easy for the front end loader 124 to dump while the rear face and sides may be raised to further contain the snow and water.

The cold water in the dump tank 112 is circulated to the melt tank 116 for warming. This water flows through piping 128 from the interior of the dump tank 112 into the melt tank 116. A pump 132 may be used to facilitate this water flow. In some embodiments, the pump 132 may be capable of pumping up to 1500 gallons per minute of water. In some embodiments, the water may be pumped from the dump tank 112 to a rear bottom portion of the melt tank 116. The water is that is pumped from the dump tank 112 into the melt tank 116 may be referred to as "return water." This water may exit at the top and opposite end of the tank. This may cause the water to flow over all of the tubes of the heat exchanger for maximum heat exchange. In the preferred embodiment, the inlet for the cold water to the pump is downward facing and large in area. This encourages dirt and debris to settle to the bottom of the tank rather than be entrained into the water flow and transported to the melt tank. This inlet is often covered with a screen to prevent large and lightweight debris from going through the pump.

Once the water enters the melt tank 116, it will be heated by the heat exchanger (not shown in FIG. 2). This heat exchanger is mounted inside of the heat exchanger tank 116, submerged in water heating the water in the tank 116. As operation initiates the in-tank water warms to the desired or predetermined level. The water will then be allowed to flow back into the dump tank 112 via a weir (not shown in FIG. 2). Once the water is returned to the dump tank 112 from the melt tank 116, the capacity of the dump tank 112 is exceeded and water may flow out of the dump tank 112 through the overflow weir 140. Once the water flows out of the dump tank 112 via the overflow weir 140, the water may then be directed via discharge valves 144 and/or piping 148 and directed into a drain system. Thus, by loading the dump tank 112 with snow and then ultimately having this snow melt into water that is directed into the drain via the valves 144/piping 148, an efficient and controlled disposal of the snow is achieved.

Clearly a burner (not shown in FIG. 2) is used to heat the water in the melt tank 116. This burner will generally burn fuel as the heating source. Accordingly, the melter 100 may include an exhaust tube 152 that disposes of the gaseous products formed during combustion. Another exhaust tube 156 from the enclosure 122 may also be used. This exhaust tube 156 may be used for the genset, as will be described.

Figure 3:
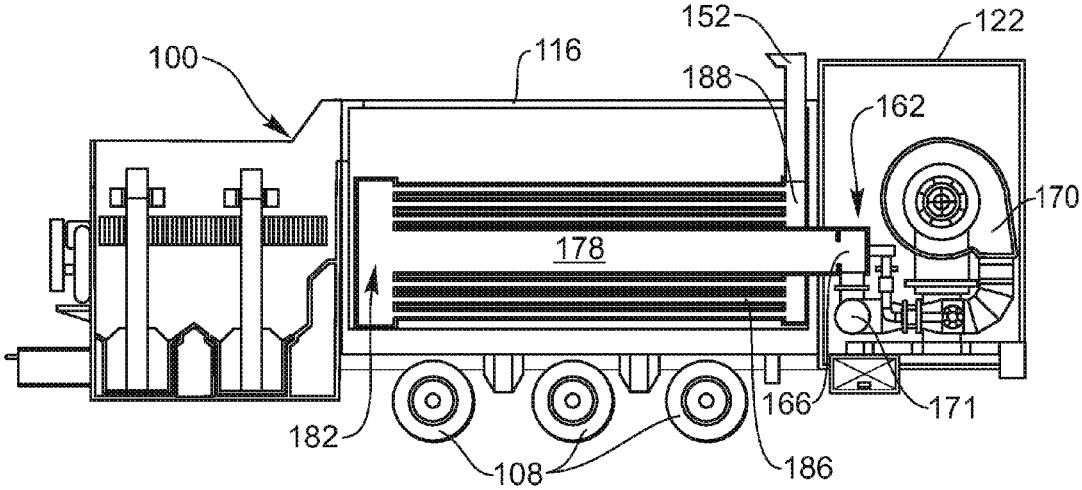
FIG. 3 a lengthwise section of the snow melter shown in FIG. 1.

Referring now to FIG. 3, a lengthwise section of the melt tank 116 and the way in which the melt tank is heated is illustrated. As can be seen in FIG. 3, the melter 100 includes a heat exchanger 162, which is a system designed to heat the water in the melt tank 116. The heat exchanger 162 includes a burner 166 which may be enclosed within the enclosure 122. The burner will burn fuel (not shown) to create a flame. The exhaust from this combustion process is channeled out through the exhaust tube 152. In order to facilitate the burning process, a combustion air fan 170 may be used to draw air to provide the air necessary for proper combustion. This fan 170 may also be positioned within the enclosure 122. This air may be mixed with fuel (or fuel oil) in a manner known in the art to produce a flame. The fuel is sent to the burner 166 (and subsequently mixed with the air) via fuel line 171.

The burner is positioned to fire into the large Morrison tube 178 of the heat exchanger 162. The water in the melt tank 116 surrounds the Morrison tube 178 and gas return tubes 186. Water fills the heat exchanger tank 116 above heat exchanger tube rack 162, until it cascades over the weir 196. Generally, the heat exchanger 162 may consist of a large Morrison tube 178 (which is a fire tube or other similar structure) into which the flame produced by the burner 166 is sent. The flame and/or gaseous products produced by the burner 166 may extend along the entire length of the large Morrison tube 178 until it reaches the turnaround box 182. Once the hot gas hits the turnaround box 182 (or turnaround area), it is returned, via a large number of gas return tubes 186 back towards the burner and then gathered in a box 188 and exhausted through the exhaust tube 152. Thus, the hot gases will heat the gas return tubes 186 which make contact with the melt water in the melt tank 116 both while hot gases are in the Morrison tube 178 and the gas return tubes 186, thereby increasing the heating and surface area contact with the melt water. In some embodiments, there may be multiple tubes 186 (even hundreds of tubes) as desired to maximize heat transfer efficiency.

As can be seen in FIG. 3, this is a closed loop heating process and at no time allows the burner flame or the exhaust gases to come in contact with the melt water. The heat exchanger is a fully enclosed fire tube, wet back or submerged heat exchanger. In some embodiments, the melter 100 may employ a 30 MM BTU diesel fired burner with a burner skid as the burner 166, which fires a flame into a fully enclosed fire tube 178. The turnaround box 182 may distribute the hot air back through hundreds of small tubes 186 (which may be 1 and ½ inches in diameter) where they meet an exhaust box 188 where the air is collected and then exhausted through tube 152. This system is, as described above, "a 2-pass exchanger," meaning that the water to be warmed comes in contact with all of the surface area of the large and small tubes and collection boxes. Thus, the exchanger 162 may be designed to achieve approximately 85% heat transfer efficiency.

Figure 4:
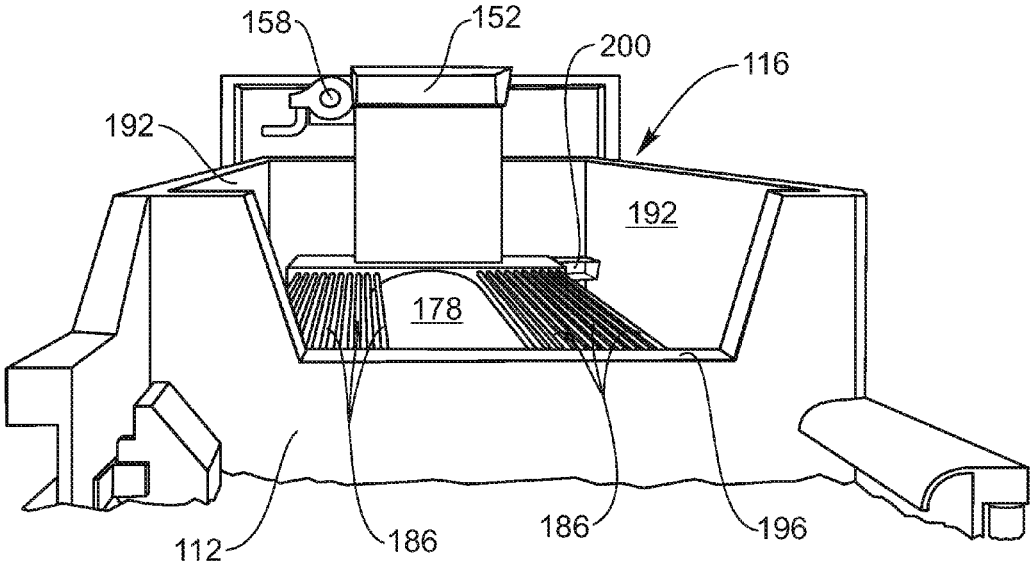
FIG. 4 is perspective view of the melt tank of FIG. 1, showing the overflow weir.

FIG. 4 is a perspective view that shows the melt tank 116 that is shown without water. As can be seen in FIG. 4, the heat exchanger 162 in the melt tank 116 includes the Morrison tube 178 (which houses the flame) and the return tubes 186, thereby allowing these heated features to contact the water in the melt tank 116. The exhaust tube is positioned above the top of the melt tank 116 so that this exhaust never contacts the water in the tank 116. The sidewalls 192 will enclose the water in the melt tank 116.

However, at one end of the melt tank 116 is a weir 196, which is an opening or other feature that allows the water heated by the Morrison tube 178/return tubes 186 to flow from the melt tank 116 back into the dump tank 112. As can be seen in FIG. 4, the melt tank 116 is generally elevated (i.e., higher) than the dump tank 112 to facilitate this flow. As described above, the water originally is pumped into the melt tank 116 from the dump tank 112 via the pump 132 (not shown in FIG. 4). This water may enter the melt tank 116 at any desired location, such as through opening 200. (In other words, the location of the opening 200 may be moved to any position inside or outside of the melt tank 116). It is preferred that the water enter at the bottom rear of the melt tank so that the water flows the full length of the heat exchanger to maximize its residence time in the tank for greatest heat transfer efficiency. As the water level in the melt tank 116 is higher than the dump tank 116, the water may want to back flow through the opening 200 and (piping 128 shown in FIG. 2) when the circulation pump 132 is not in operation. In order to prevent this backflow, a check valve (not shown) may be used. Alternatively, an electric or manual shut-off valve (not shown) could be used. Other features to prevent such backflow are also possible.

Figure 5:
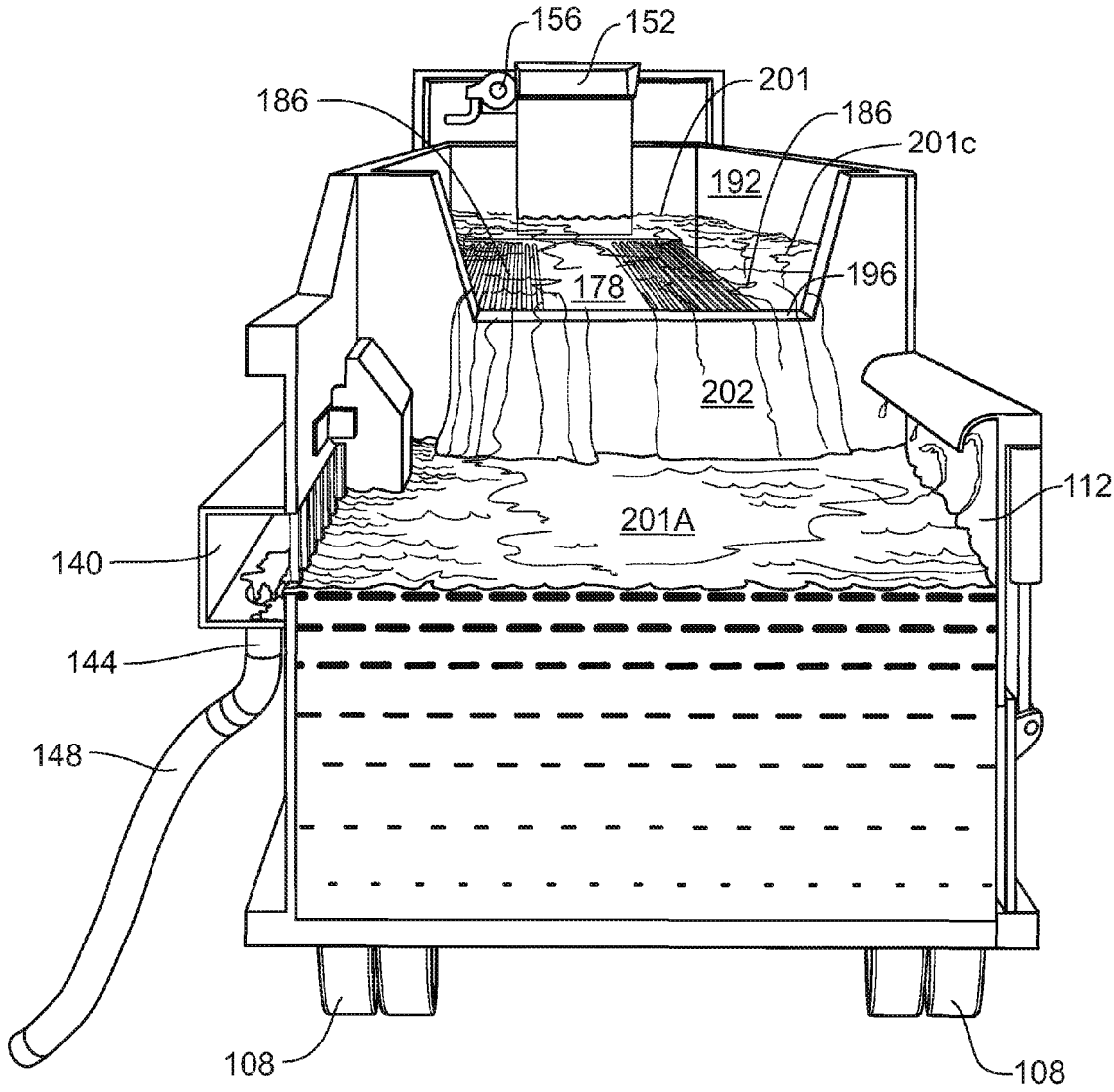
FIG. 5 is a perspective view of the of the melt tank and sectional view of the dump tank during use, wherein water is shown flowing from the melt tank to the dump tank.

FIG. 5 is a perspective view of the way in which the heated water flows (during use) from the melt tank 116 into the dump tank 112. As explained above, water is circulated from the dump tank 112 to the melt tank 116 and back again. The cold water 201A in the dump tank 112 is circulated to the heat exchanger tank via a 1500 GPM water pump 132 (not shown in FIG. 5), and then returned to the dump tank 112 via the weir 196. The water 201 may actually cascade 202 over the overflow weir 196 as it is returned to the dump tank 112. (The water that cascades is hot/warm water 201*c*). The circulation process is the constant recycling and turbulence brought about by the water pump 132 (not shown in FIG. 5) and overflow weir 196, resulting in extremely efficient operation. The cascading of the heated water may be onto the snow in the dump tank 112 to provide agitation and to promote mixing of the heated water with the snow to accelerate melting. The water could be introduced on multiple sides of the dump tank.

Referring now to FIGS. 1 through 5 collectively, the entire operation and water flow will be reviewed and summarized. There are two primary water flows in operation. First, there is pumped circulation between the dump tank 112 and the melt tank 116, and water is returned to the dump tank 112 via an overflow weir 196. The water level in the melt tank 116 is higher than the dump tank 112 to allow the water to fall in a waterfall back into the dump tank 112. Additionally, there is a lower weir 140 in the dump tank 112 for the exit of the melt water 201A. As snow is added to the dump tank and melted, the water level rises in the dump tank 112 until it overflows out of the system via this lower overflow weir 140. That water 201A is then directed via piping 148 (which may be as simple as hoses) to the ground, storm drain, or other melt water collection. In some embodiments, water that leaves the dump tank 112 (via the hoses, etc.) is at a temperature, such as 39° F., that allows the water to be directly poured into drains, etc., without risk that the water will re-freeze and freeze access to the drain. In some embodiments, in order to get the water exiting the dump tank 112 to reach 39° F., the water 201*c* in the melt tank 116 will be heated above 39° F. such that when this water mixes with the cold water/snow in the dump tank 112, the temperature of the water in the dump tank 112 that exits through the weir 140 will have a temperature of 39° F. The genset, burner controls, etc. can be used to adjust the temperature of the water in the melt tank 116 (and even continuously adjust the water temperature) such that this 39° F. temperature of the exiting water is maintained. Obviously, the temperature of the water exiting the dump tank 112 through the weir 140 depends upon a variety of factors such as ambient temperature, amount of water circulation, amount of snow added to the dump tank 112, temperature of the water in the melt tank, etc. Accordingly, using the burner controls, the user can, if desired, adjust for these factors to maintain the temperature of the water exiting the dump tank 112 via the weir 140 to be about 39° F.

In the present embodiment, when the heated water flows out of the melt tank 116 back into the dump tank 112, the water flows over an overflow weir 196 back on top of the snow. This process provides agitation to promote mixing of the hot water with the snow to accelerate melting. In the present embodiment, this weir 196 is located at one end of the dump tank 112. It could be further distributed via ducts around the sides of the dump tank 112 for more even distribution. Additionally, in other embodiments, a second pump could be used to return the water to the dump tank via a pressurized spray system. Although more expensive (and thus less preferred), this more forceful spray breaks up the snow and ice more quickly exposing more surface area to the hot water and promotes more rapid melting. This second pump could operate off of water leveling sensing in the heat exchanger tank, with on-off or proportional control to maintain the water level in the heat exchanger tank.

With respect to the pump 132 that initially moves the water from the dump tank 112 to the melt tank 116. When the water enters the melt tank 116, the water will be circulated. To maximize heat transfer, water is circulated to the bottom rear of the heat melt tank 116 (via the opening 200) and exits at the top and opposite end of the melt tank 116. This causes the water to flow over all of the tubes 186 (as well as the Morrison tube 178) of the heat exchanger 162 (shown in FIG. 3) for maximum heat exchange. In some embodiments, the tubes 186 and/or the Morrison tube 178 may not be on the melt tank floor 116; rather, in some embodiments, these features may be elevated off the floor of the melt tank 116 to allow for some accumulation of fines (i.e., fine particles) and to allow for it to be easily hosed out after use. If desired, gasketed clean out doors (not shown) may be added to the melt tank 116. When the device is no longer in use, these doors may be opened so that the melt tank 116 may be sprayed out for cleaning.

Figure 6:
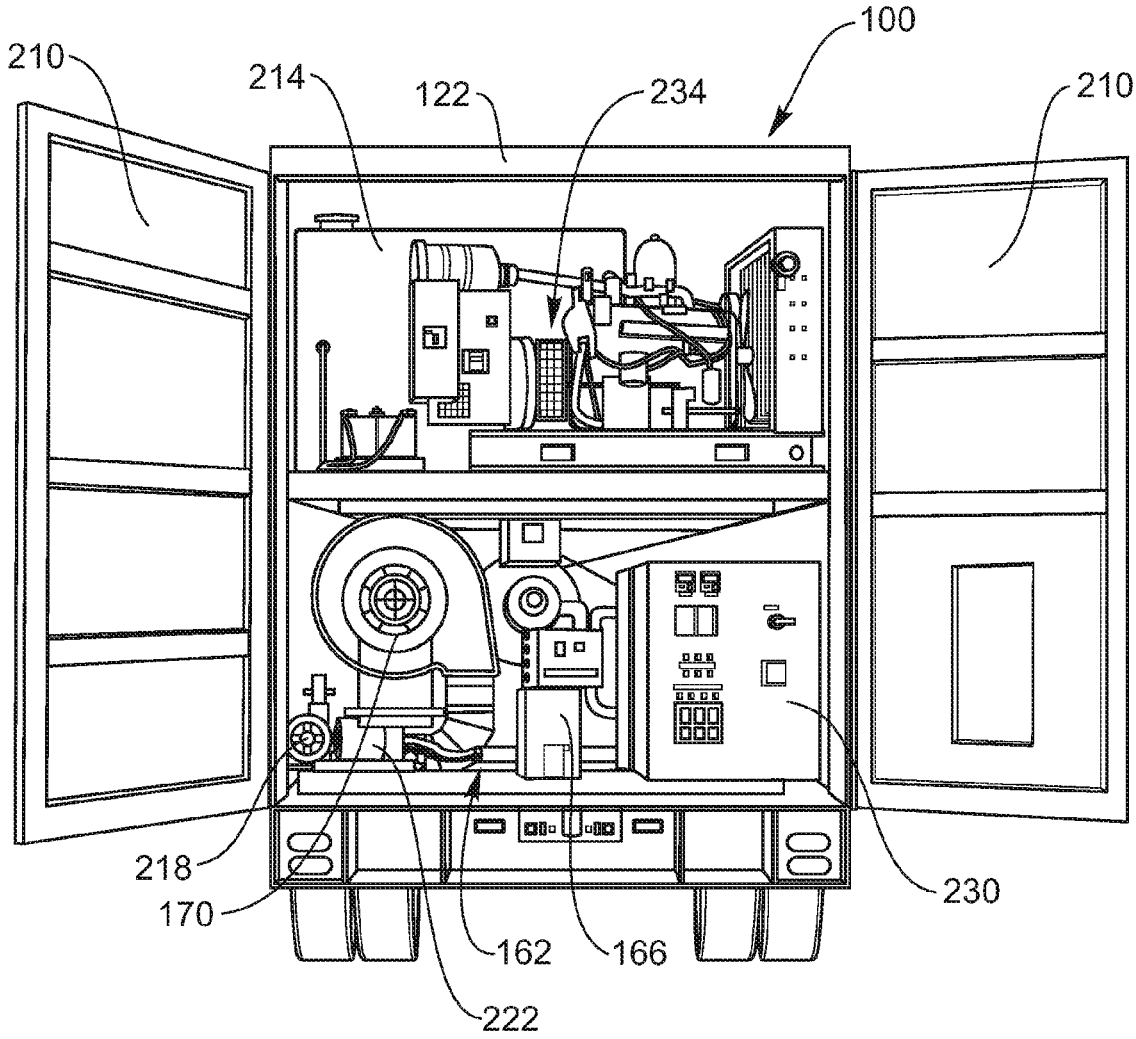
FIG. 6 is a perspective view of the enclosure housing the controls for the melter of FIG. 1.

FIG. 6 is a perspective view of the enclosure 122 that is used as part of the melter 100. The enclosure 122 may generally include one or more doors 210 that allow a user access to the interior of the enclosure 122. Such access facilitates user control of the operation of the melter 100.

As shown in FIG. 6, the burner 166 and the combustion air fan 170 may be positioned within the enclosure 122. (As noted above, these features are part of the heat exchanger 162). A fuel tank 214 may also be added within the enclosure 122. The fuel tank 214 houses the fuel (not shown) that is burned by the burner 166 during combustion. The particular fuel used may vary based upon the embodiment of the burner 166. However, in some embodiments, the fuel will be diesel fuel commercially available. A burner fuel pump 222 may also be used to inject the fuel into the burner 166 and to improve burning, etc. A hydraulic pump 218 may also be added. The function of the hydraulic pump 218 is described below.

A control panel 230 may also be used to control the heat exchanger 162. Specifically, this control panel 230 allows the user to adjust the burner 166 (such as the temperature, the fuel consumption, etc.) as well as the pump 218, the pump 132 (not shown in FIG. 6), the motor on the air fan 170, etc. and any other parameters. As known in the industry, gauges may be used to measure and adjust the burner firing, fuel flow, air flow, etc. An on/off switch for the fan 170, the burner 166, the pump 218 may be used as well as other controls.

A diesel genset 234 may also be added to power all of the pump 132 (not shown) and the other systems used in this melter 100. Again the genset 234 allows a user to control all aspects of the melter 100 including the water flow via the pump 132. Those skilled in the art will appreciate how the genset 234 and/or the control panel 230 may be implemented, modified, and used to control the melter 100. The genset 234 may include a generator and an auxiliary power unit for the melter 100.

Figure 7:
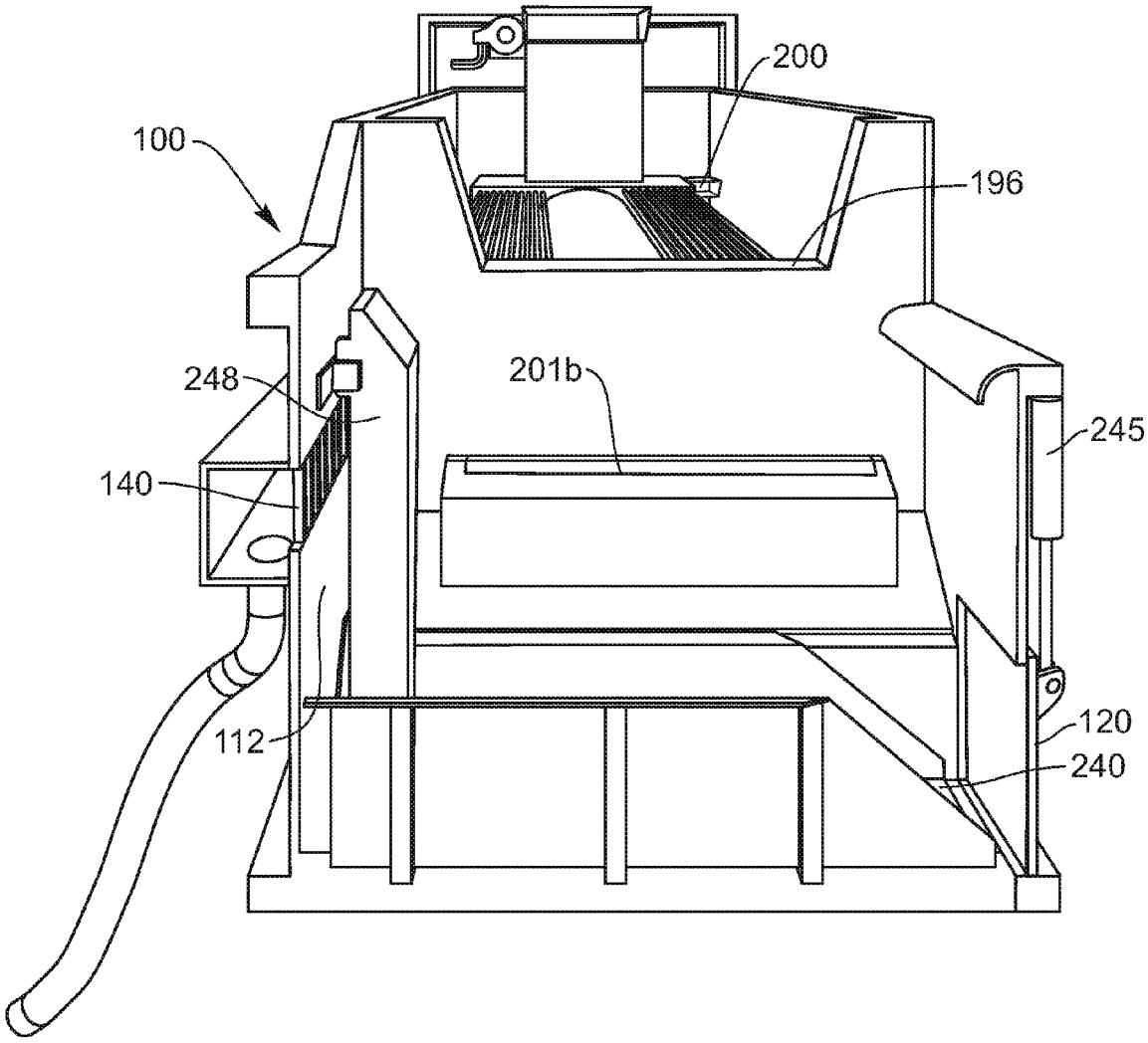
FIG. 7 is a sectional view of the dump tank of FIG. 1 that shows additional features of the snow melter that may be present.
Figure 8:
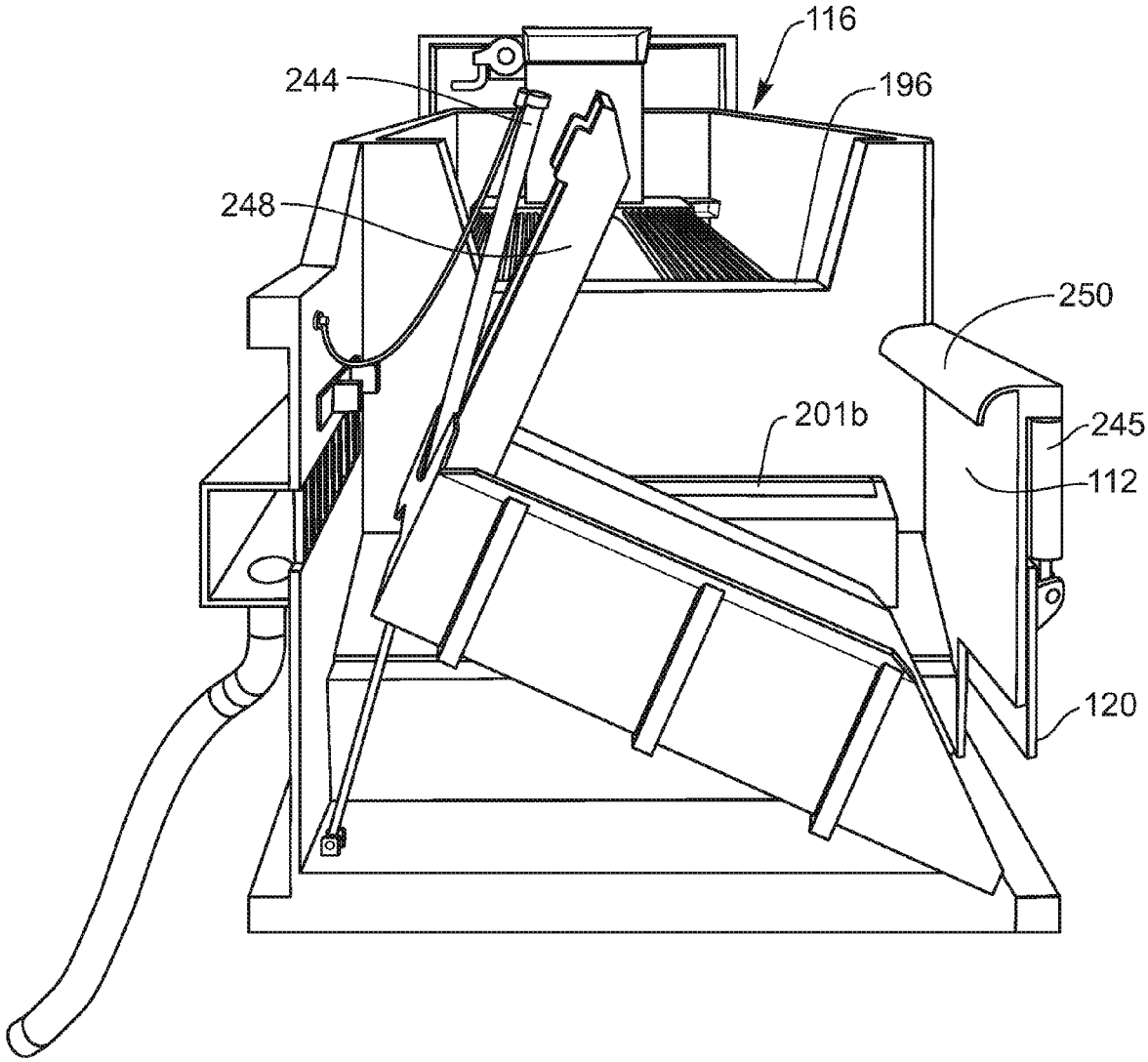
FIG. 8 is a sectional view of the dump tank of FIG. 7 showing an additional way in which this tank may be cleaned.

FIG. 7 is a perspective view of the dump tank 112 that shows additional features of the melter 100 that may be present in some embodiments. FIG. 8 is a perspective view that shows the cleaning of the dump tank 112. The water overflow weir 140 allows water to exit the dump tank 112.

As can be seen in FIGS. 7 and 8, an opening 201*b* is used as the inlet for water that is circulated via the pump 132 (not shown in FIG. 7) to the melt tank 116. Opening 201*b* may be screened to catch and prevent debris from entering the return line 128. The opening 201*b* for the circulation pump 132 may be elevated off the bottom and redirects the water first vertically through a duct before going into the pump inlet opening 201*b*. The idea is to design this inlet duct size such that solids will not be entrained into the water flow and will remain settled out at the bottom of the dump tank 112. Only light weight fines will find there way into the bottom of the melt tank 116.

The present embodiments also provide a simple and easy mechanism for cleaning out both of the tanks 112, 116 after use. Debris is settled out in the following way: when snow is dumped into the dump tank 112, the solids (rocks, sand, etc.) tend to fall to the bottom of the dump tank 112.

With respect to the pump 132 that initially moves the water from the dump tank 112 to the melt tank 116, the inlet 200 for the water circulation pump 132 may be screened to keep out large objects like sticks and bottles and may include provisions for easy clean-out, such as by hinging the top of the inlet duct. The pump inlet 201*b* may further be designed with a clean-out door that allows for easy removal of trapped debris. The inlet for the circulation pump is elevated off the bottom of the tank and redirects the water first vertically through a duct before going into the pump inlet. The design of the inlet duct size is such that solids will not be entrained into the water flow and will remain settled out at the bottom the dump tank. Only light weight fines will find their way into the bottom of the heat exchanger tank. The pump inlet may further be designed with a clean-out door. To maximize heat transfer, water is circulated to the bottom rear of the heat exchanger tank and exits at the top and opposite end of the tank. This causes the water to flow over all of the tubes of the heat exchanger for maximum heat transfer. The heat exchanger is elevated off the bottom of the tank to allow for some accumulation of fines and to allow for it to be easily hosed via gasketed doors.

It is known that it can be very difficult to clean out dump tanks 112 (after use). Some previously known snow melters expect the debris to be manually shoveled. In our system, the preferred embodiment is to slope to all sides of the dump tank 112 to funnel all debris to specific collection areas. These areas, at one or both ends, may have full width gasketed doors 120 that may be opened, after the melt water has been drained, to discharge the debris. In the simplest embodiment, the doors may be opened and then the debris shoveled out the door, but at least there are not difficult corners to deal with. Gasketed doors 120 are provided for cleaning debris from the bottom of the dump tank 112. Similar doors may also be added to the melt tank 116, as desired. For safety and ease of use, some embodiments may have hydraulic cylinders 245 that can be used to raise the doors out of the way for cleaning. Pressurized sprays of water may also be used to push the debris out of the tanks.

In our preferred embodiment of FIG. 7, the floor 240 of the dump tank 112 may be elevated (i.e., inclinable like a dump truck) that may be hydraulically raised at one end to slide the debris out the gasketed doors 120. (This is shown in FIG. 8). More specifically, one end of the floor 240 may be elevated to allow the debris to slide out of the tank 112 via the doors 120, as shown in FIG. 8. The raising of one end may be done by hydraulic cylinder 244. In other embodiments, a cable hoist or other means may be used). This hydraulic cylinder 244 may be stored within a housing 248. In some embodiments, hydraulics may be designed to raise the floor of the dump tank 112 to about 36 degrees. Secondary means may be provided to gain access to the underside of the dump tank to clean out any debris that settles there. After dumping, the stationary pivoting end of the tank may be raised perhaps 12 inches via cable hoist or hydraulics to allow further cleaning. Additionally, the dump floor 240 could be fitted with plumbing to allow the introduction of pressurized water to dislodge debris and flow it out the doors.

It should be noted that the hydraulic pump 218 (shown in FIG. 6) may control the cylinders 244 and/or the doors 120 during clean-out. More specifically, the hydraulic pump 218 may supply the proper oil pressure to open and close the cleanout doors 120 on both tanks, plus raise and lower the floor 240, etc. (In other words, the pump 218 may be used in conjunction with the cylinders 245, 244 to raise and lower the doors 120/floor 240 in a manner known in the art). Of course, all of these features may be powered by the genset 234 and/or the control panel 230.

After cleaning, the system is now in a state where the dump tank 112 has no water and must be refilled typically via water truck or fire hydrant. In an alternate embodiment, the overflow weir 196 of the melt tank 116 is fitted with a door to allow it to be closed to store additional water. At the time of cleaning, the door is closed and water in the dump tank 112 is pumped to the heat exchanger tank 116 and stored on top of the normal water level. After cleaning, valves in the face of this door can be opened to return water to the dump tank. After the water pressure has been relieved via the valves in the face of the door, the door may be opened or removed exposing the normal overflow (heat exchanger) weir 196. So operation may resume after cleaning without the need to supply additional water.

As shown in FIG. 8, a splash guard 250 may be added around the edges of the dump tank 112 and/or the melt tank 116 to prevent water from flowing out of these tanks.

Obviously, those skilled in the art will appreciate that assorted fasteners, fuel and hydraulic lines, and other components known to those skilled in the art may be used to assemble and/or facilitate operation of the melter 100.

Figure 9:
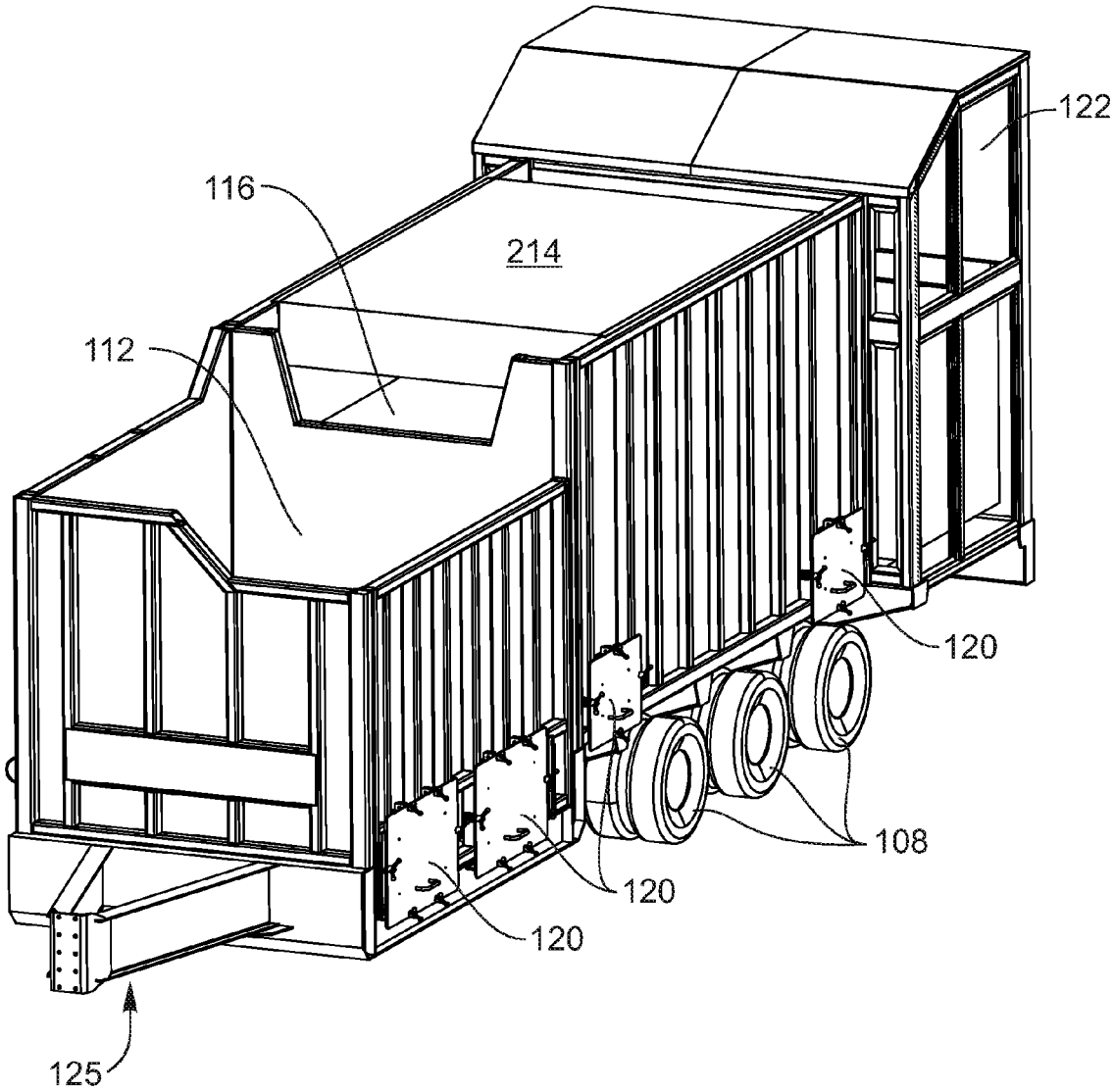
FIG. 9 is a perspective view of another embodiment of a snow melter with a similar but different configuration than the snow melter to FIG. 1.

FIG. 9 represents another embodiment of a melter 100. This embodiment is similar to that which is described above. Accordingly, for purposes of brevity, this description will not be repeated. In the embodiment of FIG. 9, the pump 132 and the piping 128 have been removed for clarity (although such features would clearly be present in the embodiment of FIG. 9). It should be noted that, in the embodiment of FIG. 9, the size of the enclosure 122 has been reduced. Again, this enclosure will house the burner 166 (shown above), the enclosure 122 encloses the burner system, the controls, the genset, and other components etc. However, in the embodiment of FIG. 9, the fuel tank 214 has been positioned on top of the melt tank 116. This may allow for the use of a larger fuel tank 214 and/or may allow the size of the enclosure 122 to be reduced. This system also shows clean-out doors hinged from the sides rather than opened vertically via hydraulic cylinders.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A snow melter comprising:

a dump tank containing heated water for receiving a quantity of snow to be melted;

a heat exchanger for heating water; and a heat exchange tank separate from the dump tank, the heat exchanger being disposed within the heat exchange tank, the heat exchange tank allowing water heated by the heat exchanger within the heat exchange tank to flow from the heat exchange tank into the dump tank to maintain a level of heated water in the dump tank to melt the snow in the dump tank encouraging any dirt or debris within the snow to settle to the bottom of the dump tank, water from the melted snow in the dump tank being dischargeable from the dump tank for disposal, wherein the heat exchange tank is elevated with respect to the dump tank such that the heated water flowing from the heat exchange tank into the dump tank will cascade into the dump tank.

2. A snow melter as in claim 1 wherein the dump tank has one or more doors.

3. A snow melter as in claim 1 wherein the dump tank has an inclinable floor.

4. A snow melter as in claim 3 wherein the inclinable floor is moveable using one or more hydraulic cylinders and a hydraulic pump.

5. A snow melter as in claim 1 wherein the heated water may cascade into the dump tank by flowing over an overflow weir.

6. A snow melter as in claim 1 further comprising piping and a pump for pumping return water from the dump tank into the heat exchange tank to be heated.

7. A snow melter as in claim 1 wherein the heat exchanger is a closed loop system comprising a burner, a Morrison tube, and one or more gas return tubes, wherein the Morrison tube and the tubes are positioned proximate at the floor of the heat exchange tank, the Morrison tube and the gas return tubes fully enclosing the flame and any products produced by the burner.

8. A snow melter as in claim 7 further comprising a control panel for adjusting the settings of the burner.

9. A snow melter as in claim 8 further comprising an enclosure positioned adjacent the heat exchange tank, the enclosure housing the control panel, the melter further comprising a diesel genset housed within the enclosure.

10. A snow melter as in claim 1 wherein the melter is towable.

11. A snow melter as in claim 1 wherein the melter is free-standing.

12. A snow melter as in claim 1 wherein the heat exchanger heats water such that the water exiting the dump tank for disposal has a temperature of about 39 degrees Fahrenheit.

13. A method of melting snow using a snow melter comprising a dump tank, a heat exchanger disposed within a heat exchange tank for heating water, the heat exchange tank being separate from the dump tank, the method comprising:

introducing a level of heated water into the dump tank;

loading snow into the heated water within the dump tank;

pumping return water from the dump tank into the heat exchange tank;

heating water in the heat exchange tank via the heat exchanger;

directing the water heated by the heat exchanger within the heat exchange tank into the dump tank to melt the snow loaded into the dump tank, the heat exchange tank is elevated with respect to the dump tank such that the water directed from the heat exchange tank into the dump tank cascades into the dump tank over an overflow weir;

encouraging any dirt or debris within the snow to settle to the bottom of the dump tank; and exiting water from the melted snow from the dump tank.

14. A method as in claim 13 wherein the heat exchanger heats water such that the water from the melted snow exiting the dump tank has a temperature of about 39 degrees Fahrenheit.

15. A snow melter comprising:

a dump tank containing heated water for receiving a quantity of snow to be melted;

a heat exchanger for heating water;

a heat exchange tank separate from the dump tank, the heat exchange tank containing water to be heated, the heat exchanger being disposed within the water within the heat exchange tank, the heat exchange tank allowing water heated by the heat exchanger within the heat exchange tank to cascade over a weir from the heat exchange tank into the dump tank to maintain a level of heated water in the dump tank to melt the snow in the dump tank encouraging any dirt or debris within the snow to settle to the bottom of the dump tank, melted snow water mixes with the heated water in the dump tank to create a water mixture that is either discharged from the dump tank for disposal or is circulated into the heat exchange tank to be heated; and an opening in the dump tank elevated off the bottom of the dump tank but below the level of heated water maintained in the dump tank, at least a portion of the water mixture within the dump tank passes through the opening and is circulated via a return line from the dump tank into the bottom of the heat exchange tank to be heated and to raise the level of the water in the heat exchange tank so that heated water cascades over the weir into the dump tank to maintain the level of heated water in the dump tank for melting snow.

16. A snow melter as in claim 15 wherein the opening redirects the water mixture first vertically before entering the return line so that solids will not be entrained into the water mixture flowing through the return line.

17. A snow melter as in claim 16 further comprising a circulation pump that pumps the water mixture through the return line.

* * * * *